US011114027B2

(12) United States Patent
Yuan et al.

(10) Patent No.: US 11,114,027 B2
(45) Date of Patent: Sep. 7, 2021

(54) OLED PIXEL CIRCUIT, AND DRIVING METHOD THEREOF, AND A DISPLAY APPARATUS

(71) Applicants: BOE TECHNOLOGY GROUP CO., LTD., Beijing (CN); Hefei Xinsheng Optoelectronics Technology Co., Ltd., Anhui (CN)

(72) Inventors: Can Yuan, Beijing (CN); Yongqian Li, Beijing (CN); Pan Xu, Beijing (CN); Zhidong Yuan, Beijing (CN); Zhenfei Cai, Beijing (CN)

(73) Assignees: BOE TECHNOLOGY GROUP CO., LTD., Beijing (CN); Hefei Xinsheng Optoelectronics Technology Co., Ltd., Anhui (CN)

( * ) Notice: Subject to any disclaimer, the term of this patent is extended or adjusted under 35 U.S.C. 154(b) by 751 days.

(21) Appl. No.: 16/063,932

(22) PCT Filed: Nov. 21, 2017

(86) PCT No.: PCT/CN2017/112090
§ 371 (c)(1),
(2) Date: Jun. 19, 2018

(87) PCT Pub. No.: WO2019/006957
PCT Pub. Date: Jan. 10, 2019

(65) Prior Publication Data

US 2021/0201776 A1 Jul. 1, 2021

(30) Foreign Application Priority Data

Jul. 4, 2017 (CN) ..... 201710539317.6

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC ..... G09G 3/32–3291; G09G 2300/08–0895; G09G 2320/043; G09G 2320/045
See application file for complete search history.

(56) References Cited

U.S. PATENT DOCUMENTS 8,558,767 B2 * 10/2013 Kwon ..... G09G 3/3233 345/77
8,902,138 B2 * 12/2014 Kim ..... G09G 3/3291 345/82
(Continued)

FOREIGN PATENT DOCUMENTS

CN 102968954 B 6/2015
CN 104751778 A 7/2015
(Continued)

OTHER PUBLICATIONS

The Extended European Search Report in the European Patent Application No. 17890839.8, dated Mar. 1, 2021.
(Continued)

*Primary Examiner* — Patrick F Marinelli
(74) *Attorney, Agent, or Firm* — Intellectual Valley Law, P.C.

(57) ABSTRACT

The present application discloses a pixel circuit, including a data-input sub-circuit configured to apply a data voltage from the data line to a first node; a reset sub-circuit configured to reset the second node; a driving-control sub-circuit coupled to a first power supply, the first node, and the second node; a power-storage sub-circuit configured to regulate a voltage difference between the first node and the second node; a light-emitting device coupled to the second node and
(Continued)

a second power supply; and a sampling sub-circuit coupled to the data line and the second node and being configured to control the data line to connect with the second node for collecting a voltage signal containing information about electrical properties of the driving-control sub-circuit and being used to generating a compensation voltage for compensating any drifts of the electrical properties.

20 Claims, 5 Drawing Sheets

(52) U.S. Cl.
CPC ..... *G09G 2300/0861* (2013.01); *G09G 2310/0202* (2013.01); *G09G 2320/0233* (2013.01); *G09G 2320/045* (2013.01); *G09G 2330/02* (2013.01)

(56) References Cited

U.S. PATENT DOCUMENTS 8,988,329 B2 * 3/2015 Yoon ..... G09G 3/3233 345/77
9,905,164 B2 * 2/2018 Mizukoshi ..... G09G 5/18
10,311,767 B2 * 6/2019 Choi ..... G09G 3/006
10,347,182 B2 * 7/2019 Wang ..... G09G 3/3266
10,504,422 B2 * 12/2019 Cheng ..... G09G 3/3225
10,535,302 B2 * 1/2020 Yuan ..... H01L 27/3276
10,755,644 B2 * 8/2020 Lee ..... G09G 3/3233
2007/0085781 A1 * 4/2007 Chung ..... G09G 3/3233 345/76
2008/0180365 A1 * 7/2008 Ozaki ..... G09G 3/3233 345/76
2008/0231562 A1 * 9/2008 Kwon ..... G09G 3/3233 345/77
2009/0051628 A1 * 2/2009 Kwon ..... G09G 3/3233 345/77
2009/0309818 A1 * 12/2009 Kim ..... G09G 3/3233 345/77
2011/0007067 A1 * 1/2011 Ryu ..... G09G 3/3241 345/214
2011/0216056 A1 * 9/2011 Yoo ..... G09G 3/3233 345/212
2013/0050292 A1 2/2013 Mizukoshi
2013/0147690 A1 6/2013 Kim et al.
2013/0162617 A1 * 6/2013 Yoon ..... G09G 3/3233 345/211
2015/0123953 A1 5/2015 Shim et al.
2015/0187271 A1 * 7/2015 Bae ..... H01L 27/14612 345/690
2016/0078813 A1 3/2016 Mizukoshi
2016/0086539 A1 * 3/2016 Mizukoshi ..... G09G 5/18 345/690
2016/0189614 A1 6/2016 Tani et al.
2017/0162122 A1 6/2017 In
2017/0270867 A1 * 9/2017 Zhu ..... G09G 3/3233
2018/0151099 A1 * 5/2018 Choi ..... H01L 27/1225
2019/0139488 A1 * 5/2019 Wang ..... G09G 3/3233
2019/0164481 A1 * 5/2019 Yuan ..... G09G 3/3266
2020/0020278 A1 * 1/2020 Lee ..... G09G 3/3275
2020/0335045 A1 * 10/2020 Jeong ..... G09G 3/3233
2020/0365088 A1 * 11/2020 Lee ..... G09G 3/3275
2020/0388218 A1 * 12/2020 Han ..... G09G 3/3233
2021/0049964 A1 * 2/2021 Yuan ..... G09G 3/3258

FOREIGN PATENT DOCUMENTS

CN 105741784 A 7/2016
CN 105895007 A 8/2016
CN 105913801 A 8/2016
KR 101577907 B1 12/2015

OTHER PUBLICATIONS

International Search Report & Written Opinion dated Apr. 4, 2018, regarding PCT/CN2017/112090.

* cited by examiner

OLED PIXEL CIRCUIT, AND DRIVING METHOD THEREOF, AND A DISPLAY APPARATUS

CROSS-REFERENCE TO RELATED APPLICATION

This application is a national stage application under 35 U.S.C. § 371 of International Application No. PCT/CN2017/112090, filed Nov. 21, 2017, which claims priority to Chinese Patent Application No. 201710539317.6, filed Jul. 4, 2017, the contents of which are incorporated by reference in the entirety.

TECHNICAL FIELD

The present invention relates to display technology, more particularly, to an organic light-emitting diode (OLED) pixel circuit, and a method for driving the OLED pixel circuit, a display panel having the OLED pixel circuit and a display apparatus.

BACKGROUND

Organic Light-Emitting Diode (OLED) display technology is popular today and is advantageous over Liquid Crystal Display (LCD) in low power consumption, self-luminous, wide viewing angle, and fast response speed. OLED display panel has been applied in smart phone, PDA, digital camera to replace traditional LCD display panel. In the OLED display panel technology, pixel circuit design plays an important role.

Unlike the LCD display panel of using stable driving voltage to control pixel brightness, OLED display panel is controlled by a driving current. A stable driving current is needed to control each light-emitting diode to emit light. Due to process variation and device aging effect, pixel luminance nonuniformity exists in the threshold voltage of each driving transistor in the pixel circuit. Additionally, the carrier mobility associated with the driving transistor is also drifted along with temperature variation. Therefore, even input image data are provided with a same gray scale level, the luminous level on the display panel still shows variation among different pixels, reducing the display effect of the whole image.

SUMMARY

In an aspect, the present disclosure provides a pixel circuit. The pixel circuit includes a data-input sub-circuit having a first terminal coupled to a data line, a second terminal coupled to a first scan line configured to be provided with a first control signal, a third terminal coupled to a first node, and being configured to using the first control signal to control application of a data voltage from the data line to the first node. The pixel circuit further includes a reset sub-circuit having a first terminal coupled to a reset line, a second terminal coupled to a third scan line configured to be provided with a third control signal, and a third terminal coupled to a second node, and being configured to using the third control signal to control application of a reset voltage from the reset line to the second node. Additionally, the pixel circuit includes a driving-control sub-circuit having a first terminal coupled to a first power supply, a second terminal coupled to the first node, and a third terminal coupled to the second node. The pixel circuit further includes a power-storage sub-circuit having a first terminal coupled to the first node and a second terminal coupled to the second node, and being configured to regulate a voltage difference between the first node and the second node. Furthermore, the pixel circuit includes a light-emitting device having a first terminal coupled to the second node and a second terminal coupled to a second power supply. Moreover, the pixel circuit includes a sampling sub-circuit having a first terminal coupled to the data line, a second terminal coupled to a second scan line configured to be provided with a second control signal, and a third terminal coupled to the second node, and being configured to use the second control signal to control the second node being connected to the data line.

Optionally, the driving-control sub-circuit includes a driving transistor having a gate being the second terminal of the driving-control sub-circuit coupled to the first node, a source being the first terminal of the driving-control sub-circuit coupled to the first power supply, and a drain being the third terminal of the driving-control sub-circuit coupled to the second node.

Optionally, the data-input sub-circuit includes a first switch transistor having a gate being the second terminal of the data-input sub-circuit coupled to the first scan line, a source being the first terminal of the data-input sub-circuit coupled to the data line, and a drain being the third terminal of the data-input sub-circuit coupled to the first node.

Optionally, the sampling sub-circuit includes a second switch transistor having a gate being the second terminal of the sampling sub-circuit coupled to the second scan line, a source being the third terminal of the sampling sub-circuit coupled to the second node, and a drain being the first terminal of the sampling sub-circuit coupled to the data line.

Optionally, the reset sub-circuit includes a third switch transistor having a gate being the second terminal of the reset sub-circuit coupled to the third scan line, a source being the first terminal of the reset sub-circuit coupled to the reset line, and a drain being the third terminal of the reset sub-circuit coupled to the second node.

Optionally, the power-storage sub-circuit includes a capacitor having a first terminal being the first terminal of the power-storage sub-circuit coupled to the first node and a second terminal being the second terminal of the power-storage sub-circuit coupled to the second node.

Optionally, the first power supply provides a positive voltage and the second power supply provides a negative voltage or is grounded.

Optionally, the pixel circuit further includes an ADC sub-circuit, a DAC sub-circuit, a first switch sub-circuit, and a second switch sub-circuit. The ADC sub-circuit is coupled to the data line through the first switch sub-circuit and is configured to collect an analog voltage signal in the data line during a sampling period when the first switch sub-circuit is in conduction state and convert the analog voltage signal to a digital signal which is used by a processor to calculate a compensated data voltage. The DAC sub-circuit is configured to convert a digital signal associated with the compensated data voltage to an analog voltage signal and is coupled to the data line through the second switch sub-circuit to send the analog voltage signal to the data line during an emission period when the second switch sub-circuit is in conduction state.

Optionally, the first switch sub-circuit includes a fourth switch transistor having a gate being controlled by a first select signal, a source coupled to the data line, and a drain coupled to the ADC sub-circuit. The first select signal is configured to be set to a turn-on level to make the first switch sub-circuit in conduction state.

Optionally, the second switch sub-circuit includes a fifth switch transistor having a gate being controlled by a second select signal, a source coupled to the DAC sub-circuit, and a drain coupled to the data line. The second select signal is configured to be set to a turn-on level to make the second switch-sub-circuit in conduction state.

In another aspect, the present disclosure provides a method of driving a pixel circuit described herein in each cycle of displaying a frame of image. The cycle includes a reset period, a threshold-compensation period, a data-input period, a sampling period, and an emission period. The method includes, in the reset period, supplying the first control signal from the first scan line to control the data-input sub-circuit to connect the data line to the first node; applying a reference voltage from the data line to the first node; supplying the third control signal from the third scan line to control the reset sub-circuit to connect the reset line to the second node; and applying a the reset voltage from the reset line to the second node. Additionally, the method includes, in the threshold-compensation period, supplying the first control signal from the first scan line to control the data-input sub-circuit to connect the data line to the first node; using the reference voltage at the first node to make the driving-control sub-circuit in conduction state; and using the first power supply through the driving-control sub-circuit to charge the second node to a first voltage equal to the reference voltage minus a threshold voltage associated with the driving-control sub-circuit. The method further includes, in the data-input period, supplying the first control signal from the first scan line to control the data-input sub-circuit to connect the data line to the first node; applying an original data voltage from the data line to the first node; and using the power-storage sub-circuit to maintain a voltage difference stable between the first node and the second node and change the second node to a second voltage. Furthermore, the method includes, in the sampling period, supplying the second control signal from the second scan line to control the sampling sub-circuit to connect the data line to the second node; using the first power supply through the driving-control sub-circuit and the sampling sub-circuit to charge the data line; and collecting a voltage signal from the data line corresponding to the second voltage at the second node to determine a compensation voltage based on the voltage signal. Moreover, the method includes, in the emission period, supplying the first control signal from the first scan line to control the data-input sub-circuit to connect the data line to the first node; and providing a compensated data voltage to the first node for controlling the driving-control sub-circuit to determine a driving current flown from the first power supply through the driving-control sub-circuit to drive the light-emitting device to emit light. The driving current is independent from the threshold voltage and carrier mobility drift.

Optionally, the method further includes, in the reset period, supplying the second control signal from the second scan line to control the sampling sub-circuit to disconnect the data line from the second node. The method also includes, in the threshold-compensation period, supplying the second control signal from the second scan line to control the sampling sub-circuit to disconnect the data line from the second node and supplying the third control signal from the third scan line to control the reset sub-circuit to disconnect the reset line from the second node. The method still includes, in the data-input period, using the original data voltage at the first node to make the driving-control sub-circuit in conduction state, supplying the second control signal from the second scan line to control the sampling sub-circuit to disconnect the data line from the second node and supplying the third control signal from the third scan line to control the reset sub-circuit to disconnect the reset line from the second node to maintain the second node at the second voltage. The method furthermore includes, in the sampling period, supplying the first control signal from the first scan line to control the data-input sub-circuit to disconnect the data line from the first node and supplying the third control signal from the third scan line to control the reset sub-circuit to disconnect the reset line from the second node. The method moreover includes, in the emission period, supplying the second control signal from the second scan line to control the sampling sub-circuit to disconnect the data line from the second node and supplying the third control signal from the third scan line to control the reset sub-circuit to disconnect the reset line from the second node.

Optionally, the method further includes, after the data-input period and before the sampling period, supplying the first control signal from the first scan line to disconnect the data line from the first node to make the first node floating at the original data voltage to keep the driving-control sub-circuit in conduction state, and resetting the data line to a zero voltage before being charged through the sampling sub-circuit in the sampling period.

Optionally, in the sampling period, the method of collecting a voltage signal from the data line corresponding to the second voltage at the second node to determine a compensation voltage includes supplying the first select signal at a turn-on level to turn the first select switch sub-circuit to an on-state, sending the voltage signal to an ADC sub-circuit to convert the voltage signal to a digital signal, sending the digital signal to a processor to calculate a compensation voltage based on the second voltage at the second node and to calculate the compensated data voltage based on the compensation voltage and an original data voltage.

Optionally, in the emission period, the method of providing a compensated data voltage to the first node includes supplying the second select signal at a turn-on level to turn the second select switch sub-circuit to an on-state, sending the compensated data voltage from an DAC sub-circuit to the data line through the data-input sub-circuit to the first node.

In yet another aspect, the present disclosure provides a method of driving a pixel circuit described herein in each cycle of displaying a frame of image. The cycle includes a node-reset period, a sampling period, a reset period, a threshold-compensation period, a data-input period, and an emission period. The method includes, in the node-reset period, supplying the first control signal from the first scan line to control the data-input sub-circuit to connect the data line to the first node, providing an original data voltage from the data line to the first node, supplying the third control signal from the third scan line to control the reset sub-circuit to connect the reset line to the second node, and providing the reset voltage from the reset line to the second node. The method further includes, in the sampling period, supplying the second control signal from the second scan line to control the sampling sub-circuit to connect the data line to the second node, charging the data line from the first power supply through the driving-control sub-circuit and the sampling sub-circuit while charging the second node to a first voltage, collecting a voltage signal from the data line corresponding to the first voltage at the second node and to determine a compensation voltage based on the first voltage. The compensation voltage is calculated based on current electric properties associated with the driving-control sub-circuit and the light-emitting device and is used to determine a compensated data signal. Additionally, the method includes, in the reset period, supplying the first control signal from the first scan line to control the data-input sub-circuit to connect the data line to the first node; applying a reference voltage from the data line to the first node; supplying the third control signal from the third scan line to control the reset sub-circuit to connect the reset line to the second node; and applying a reset voltage from the reset line to the second node. The method further includes, in the threshold-compensation period, supplying the first control signal from the first scan line to control the data-input sub-circuit to connect the data line to the first node; using the reference voltage at the first node to make the driving-control sub-circuit in conduction state; and using the first power supply through the driving-control sub-circuit to charge the second node to a second voltage equal to the reference voltage minus a threshold voltage associated with the driving-control sub-circuit. Furthermore, the method includes, in the data-input period, supplying the first control signal from the first scan line to control the data-input sub-circuit to connect the data line to the first node; applying an original data voltage from the data line to the first node; and using the power-storage sub-circuit to maintain a voltage difference stable between the first node and the second node with the second node being changed to a third voltage. Moreover, the method includes, in the emission period, supplying all the first control signal, the second control signal, and the third control signal at turn-off level to disconnect the data line from the first node and second node and disconnect the reset line from the second node, using the voltage difference between the first node and the second node maintained by the power-storage sub-circuit to control the driving-control sub-circuit to generate a driving current to drive the light-emitting device to emit light. The driving current is at least independent from the threshold voltage.

Optionally, the method further includes, after the node-reset period and before the sampling period, supplying the first control signal from the first scan line to disconnect the data line from the first node to make the first node floating at the original data voltage to keep the driving-control sub-circuit in conduction state, and resetting the data line to a zero voltage before being charged through the sampling sub-circuit in the sampling period.

Optionally, in the sampling period, the method of charging the data line includes supplying the first control signal from the first scan line to control the data-input sub-circuit to disconnect the data line from the first node to make the first node floating, and supplying the third control signal from the third scan line to control the reset sub-circuit to disconnect the reset line from the second node.

Optionally, in the sampling period, the method of collecting a voltage signal from the data line corresponding to the first voltage at the second node to determine a compensation voltage includes supplying the first select signal at a turn-on level to turn the first select switch sub-circuit to an on-state, sending the voltage signal to an ADC sub-circuit to convert the voltage signal to a digital signal, sending the digital signal to a processor to calculate a compensation voltage based on the first voltage at the second node and to calculate the compensated data voltage based on the compensation voltage and an original data voltage.

Optionally, the method further includes, in an alternate emission period after the sampling period, supplying the first control signal from the first scan line to control the data-input sub-circuit to connect the data line to the first node, supplying the second select signal at a turn-on level to turn the second select switch sub-circuit to an on-state, sending the compensated data voltage from an DAC sub-circuit to the data line through the data-input sub-circuit to the first node, using the compensated data voltage to control the driving-control sub-circuit to determine a driving current to drive the light-emitting device to emit light. The driving current is independent from electrical property drifts associated with the driving-control sub-circuit and the light-emitting device.

In still yet another aspect, the present disclosure provides an organic light-emission display panel including a plurality of pixel circuits described herein.

In another aspect, the present disclosure provides a display apparatus including an organic light-emission display panel described herein.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

In order to reduce non-uniformity of pixel images in the OLED display, many efforts have put on making proper compensations to the drifted electrical properties of the driving transistor. On the one hand, a so-called internal compensation is often used in certain designs of pixel circuit for generating a driving current that is able to compensate the drift of the threshold voltage of the driving transistor. But, conventional pixel circuit design with internal compensation can only compensate the threshold voltage drift in a relative small range while provide poor compensation to the carrier mobility. On the other hand, a so-called external compensation may be able to provide very good compensations to both the threshold voltage and carrier mobility of the driving transistor in the pixel circuit but has a major reliability drawback due to complicated circuit design, large volume of data processing, and prone to errors in the data processing and transmission.

Accordingly, the present disclosure provides, inter alia, a pixel circuit, a method of driving the pixel circuit, an organic light-emitting diode (OLED) display panel, and a display apparatus having the same, that substantially obviate one or more of the problems due to limitations and disadvantages of the related art.

Figure 1:
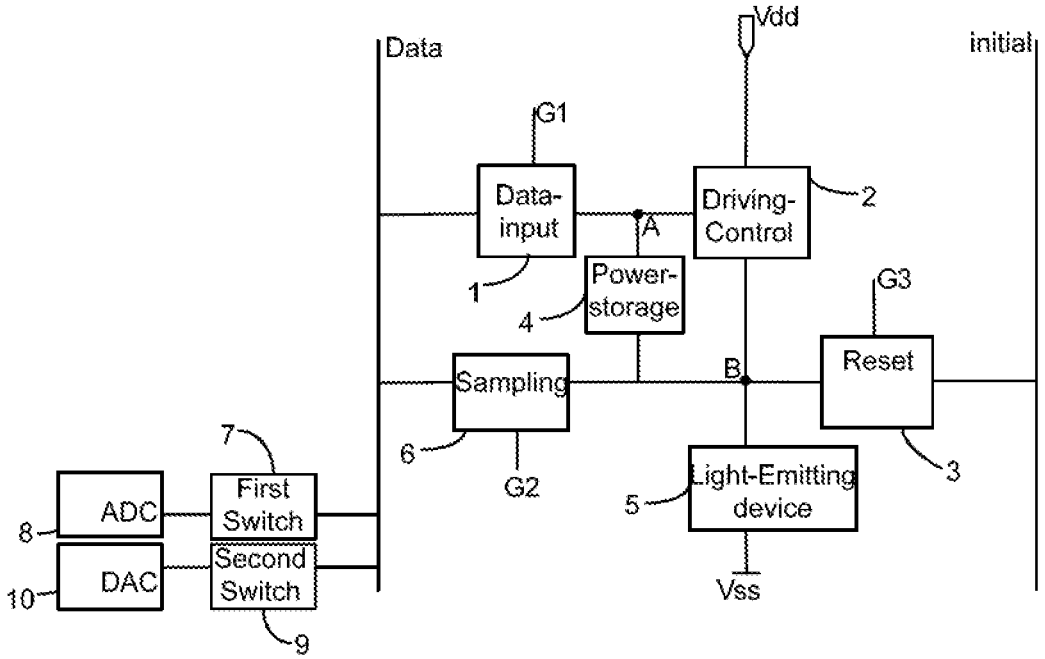
FIG. 1 is a simplified block diagram of a pixel circuit according to some embodiments of the present disclosure.

In one aspect, the present disclosure provides a pixel circuit adopted in an organic light-emitting diode (OLED) display panel for providing enhanced image uniformity in the corresponding display area. FIG. 1 is a simplified block diagram of a pixel circuit according to some embodiments of the present disclosure. The block diagram shows that the pixel circuit includes at least a data-input sub-circuit 1, a driving-control sub-circuit 2, a reset sub-circuit 3, a power-storage sub-circuit 4, a light-emitting device 5, and a sampling sub-circuit 6 electrically coupled to at least a data line (Data), a reset line (Initial), several scan lines G1, G2, and G3, a first power supply Vdd and a second power supply Vss.

Referring to FIG. 1, the data input sub-circuit 1 is coupled to the data line Data, a first scan line G1, and a first node A of the pixel circuit. The data input sub-circuit 1 is configured to provide a data signal from the data line Data to the first node A under a control of a first control signal supplied from the first scan line G1.

The reset sub-circuit 3 is coupled to the reset line Initial, a third scan line G3, and a second node B of the pixel circuit. The reset sub-circuit 3 is configured to provide a reset signal from the reset line Initial to the second node B under a control of a third control signal supplied from the third scan line G3.

The driving-control sub-circuit 2 is coupled to the first power supply Vdd, the first node A, and the second node B. The driving-control circuit 2 is configured to drive the light-emitting device 5 to emit light under a control of a voltage at the first node A.

The power-storage sub-circuit 4 is coupled to the first node A, the second node B, and is configured to regulate a voltage difference between the first node A and the second node B.

The light-emitting device 5 is coupled to the second node B and the second power supply Vss.

The sampling sub-circuit 6 is coupled to the data line Data, the second scan line G2, and the second node B. The sampling sub-circuit 6 is configured to connect the second node B to the data line Data under a control of the second control signal provided to the second scan line.

In an embodiment, the pixel circuit disclosed in FIG. 1 is able to perform an internal compensation to compensate a threshold voltage associated with a driving transistor in the driving-control sub-circuit 2. Additionally, the sampling sub-circuit 6 is able to connect the second node to the data line to allow a current signal be collected from the second node B which is depended upon the carrier mobility of the driving transistor. In an embodiment, the pixel circuit of FIG. 1 also includes a first switch sub-circuit 7 coupled to the data line, and an ADC sub-circuit 8 coupled to the first switch sub-circuit 7. The first switch sub-circuit is turned on to allow the ADC sub-circuit 8 to receive the current signal. The ADC sub-circuit 8 is able to couple with an external processor to process the current signal and generate a compensation signal. Based on the compensation signal and original data signal for displaying a pixel image, a compensated data signal can be calculated. Moreover, the pixel circuit of FIG. 1 also includes a DAC sub-circuit 10 coupled to a second switch sub-circuit 9 which is also coupled to the data line. The DAC sub-circuit 10 is configured to send the compensated data signal through the second switch sub-circuit 9 back to the data line for compensating the drift of the carrier mobility. In fact, the current signal collected from the data line corresponding to a voltage level at the second node contains information about other electrical properties beyond the carrier mobility associated with the driving transistor of the driving-control sub-circuit 2 as well as the light-emitting device 5. Therefore, the compensated data signal sent back from the DAC sub-circuit 10 is also able to properly compensate drifts or variations of those other electrical properties other than the carrier mobility.

Figure 2:
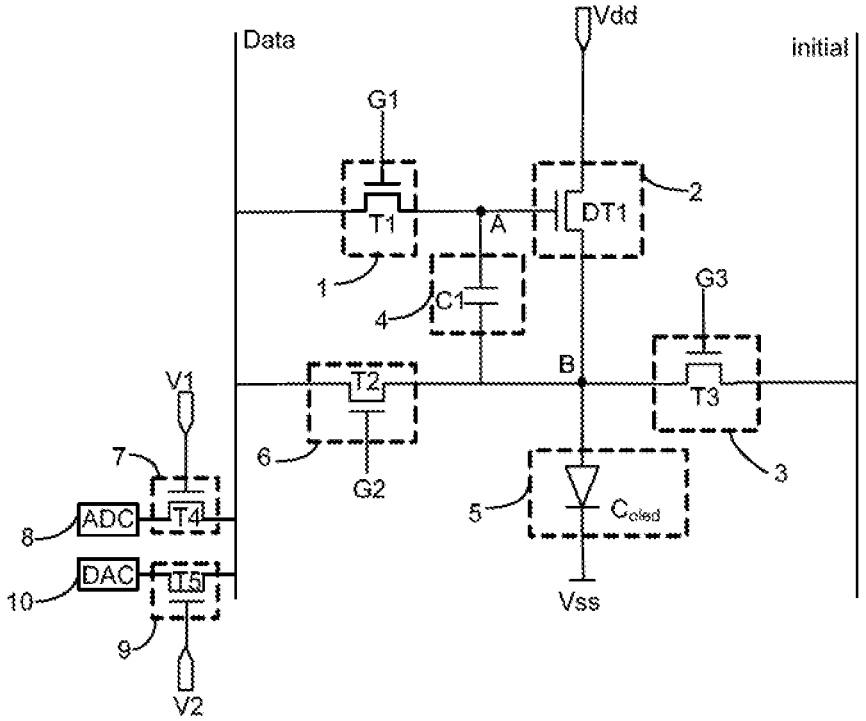
FIG. 2 is a structure of an organic light-emitting diode (OLED) pixel circuit according to an embodiment of the present disclosure.

In a specific embodiment, the pixel circuit of FIG. 1 is given in more details in FIG. 2. As shown, the driving-control sub-circuit 2 includes a driving transistor DT1 having a gate terminal coupled to the first node A, a source coupled to the first power supply Vdd, and a drain coupled to the second node B. Optionally, the driving transistor DT1 is an N-type transistor. Correspondingly, the first power supply Vdd provides a positive voltage and the second power supply Vss provides a negative voltage or is simply grounded.

Referring to FIG. 2, the data-input sub-circuit 1 includes a first switch transistor T1 having a gate terminal coupled to the first scan line G1, a source coupled to the data line Data, and a drain coupled to the first node A. Optionally, the first switch transistor T1 is an N-type transistor which is in a conduction state (on-state) when the first scan line G1 is provided with the first control signal at a high-level voltage or is in a block state (off-state) when the first control signal is a low-level voltage. Alternatively, the first switch transistor T1 can be a P-type transistor and is operated by opposite polarity of the first control signal provided at the first scan line G1. When the first switch transistor is in an on-state, it allows a data signal to be passed through the first switch transistor T1 and applies a voltage corresponding to the data signal to the first node A.

The sampling sub-circuit 6 includes a second switch transistor T2 having a gate terminal coupled to the second scan line G2, a source coupled to the second node B. and a drain coupled to the data line Data. When the second switch transistor is turned on by a second control signal at a turn-on level provided to the second scan line G2, the data line and the second node B will be at the same voltage level. The voltage at the second node B contains information about the current electric properties such as the threshold voltage and carrier mobility of the driving transistor DT. In this case, a voltage signal collected at the data line is equivalent to the voltage at the second node, thus, the voltage signal collected at the data line will be processed to achieve compensation to the carrier mobility of the driving transistor.

Referring to FIG. 2 again, the reset sub-circuit 3 includes a third switch transistor T3 having a gate coupled to the third scan line G3, a source coupled to the reset line Initial, and a drain coupled to the second node B. When the third switch transistor is turned on by setting a third control signal at a turn-on level from the third scan line, a reset voltage can be applied through the third switch transistor T3 to the second node B to reset the second node potential level.

The power-storage sub-circuit 4 is a capacitor C1 having a first terminal coupled to the first node A and a second terminal coupled to the second node B. The capacitor C1 is used to regulate the voltage difference between the first node A and the second node B based on its charging and coupling function. Optionally, the capacitor C1 is to maintain the voltage difference stable during certain period of display cycle. In an embodiment, the capacitor C is able to maintain the voltage difference stable between the first node and the second node. Optionally, if the voltage level at the first node changes, the voltage level at the second node is changed accordingly.

In the embodiment, the light-emitting device 5 is an organic light-emitting diode (OLED) having a first electrode coupled to the second node B and a second electrode coupled to the second power supply Vss (or optionally a ground voltage). The OLED is driven by a current signal to emit light. The current signal is substantially determined by the driving transistor DT1 controlled by the voltage at the first node A and the voltage at the second node B.

Referring to FIG. 2, the first Switch sub-circuit 7 includes a fourth switch transistor T4 having a first terminal coupled to the data line Data, a second terminal coupled to the ADC sub-circuit 8, and a gate being controlled by a first select signal V1. If V1 is set to a turn-on level the fourth switch transistor is in a conduction state and if V1 is set to a turn-off level the fourth transistor is in a block state. The ADC sub-circuit 8 is an analog-to-digital conversion circuit configured to convert an analog signal received from the data line through the fourth transistor T4 to a digital signal, and send the digital signal to an external processor (not shown) to process the digital signal to calculate a compensation voltage based on a compensation algorithm. The second Switch sub-circuit 9 includes a fifth switch transistor having a first terminal coupled to a DAC sub-circuit 10 and a second terminal coupled to the data line Data, and a gate being controlled by a second select signal V2. The DAC sub-circuit 10 is configured to, at a proper period depended on a control scheme, convert a digital signal to an analog voltage. If V2 is set to a turn-on level, the fifth switch transistor T5 will be in a conduction state to allow the current signal to pass from the DAC sub-circuit 10 to the data line. Optionally, the analog voltage carries a compensated data signal that is deduced from a compensation voltage obtained by the processor and at least an original data voltage that was supposed to drive the light-emitting device to emit light normally for displaying a pixel image.

Again, the second, third, fourth, and fifth switch transistors mentioned above can be either a N-type transistor or a P-type transistor, which can be operated to achieve respective desired function at either on-state or off-state only by setting the corresponding turn-on level or turn-off level to an opposite polarity. In the FIG. 2 of the specification, as an example, all the transistors are N-type transistors. The turn-on level of the transistor is represented by a high voltage level, denoted by "1" and the turn-off level of the transistor is a low voltage level, denoted by "0". Optionally, each switch transistor is a thin-film transistor. Optionally, each switch transistor is a MOS transistor. Optionally, the source and drain of each transistor can be interchanged or simply referred to the first terminal and the second terminal thereof.

Figure 3:
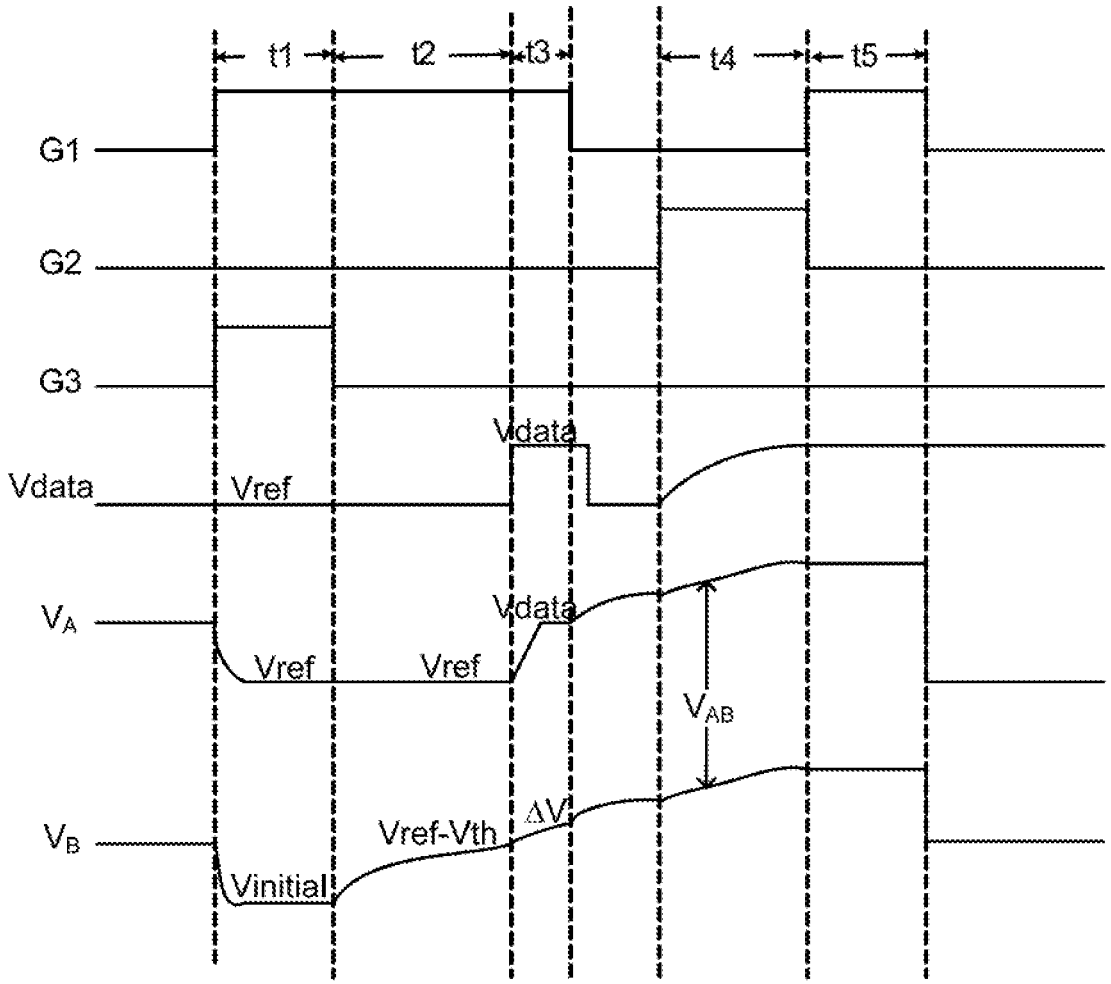
FIG. 3 is a timing diagram of operating the OLED pixel circuit according to an embodiment of the present disclosure.

For operating the pixel circuit shown in FIG. 2, a timing diagram of applying major control signals and setting corresponding voltages at data line and circuit nodes is provided in FIG. 3 in a single cycle of displaying one frame of (pixel) image. In an embodiment, the single cycle includes at least five periods: a reset period t, a threshold-compensation period t2, a data-input period t3, a sampling period t4, and an emission period t. By executing various steps of controlling one or more sub-circuits in the pixel circuit in each of the five periods in certain order as depicted in the figure, the pixel circuit is able to drive the OLED to emit light with a proper emission intensity with both internal compensation and external compensation to eliminate potential electrical property drift effect associated with the driving transistor and the OLED itself. Optionally, the timing diagram may include all the five periods but with some periods being in different orders relative to others. Optionally, between two periods shown in the timing diagram, there may be a gap time of variable duration. Optionally, from one cycle to a next cycle, there may be another gap time of variable duration.

Referring to FIG. 3 and FIG. 2, in the reset period t1, all control signals are set as: G1=1, G2=0, G3=1, V1=0, and V2=0. The driving transistor DT1, the first switch transistor T1, and the third switch transistor T3 are made to be a conduction state. The second switch transistor T2, the fourth switch transistor T4, and the fifth switch transistor T5 are turned off. In this period, the data line is provided a reference voltage Vdata=Vref which is applied through the first switch transistor T1 to the first node A. So, $V_A$=Vref. In this period, the reset line is provided with a reset signal Vinitial, which is applied to through the third switch transistor T3 to the second node B. So, $V_B$=Vinitial. In other words, the first node A and the second node B are respectively reset by a data signal Vdata (which is Vref) and a reset signal Vinitial. Here the Vref is a reference voltage and not the original data voltage loaded to the data line when the pixel circuit is normally operated for displaying a pixel image.

In the threshold-compensation period t2, the control signals are set as: G1=1, G2=0, G3=0, V1=0, V2=0. DT1, T1 are in conduction state. T2, T3, T4, and T5 are in block state. In this period, Vdata=Vref is applied to the first node A, i.e., $V_A$=Vref. The first power supply Vdd through the DT1 in conduction state to charge the second node B until it reaches a first voltage level $V_B$=Vref−Vth, here Vth is a threshold voltage of the driving transistor DT1. In this period t2, Vdata is set to a same voltage level as in the reset period t1 for controlling the voltage level at first node A.

In the data-input period t3, the control signals are set as: G1=1, G2=0, G3=0, V1=0, and V2=0. Again, DT1 and T1 are turned on and T2, T3, T4, and T5 are turned off. In this period, an original data signal set for displaying a pixel image with a desired intensity Vdata is loaded to the data line, which is in turn passed to the first node A. So, $V_A$=Vdata (or change from Vref in period t2 to Vdata in period t3). Due to coupling effect of the capacitor C1, the voltage level at the second node B will be changed to a second voltage at $V_B$=Vref−Vth+ΔV. The OLED itself has an effective capacitance Coled. The ΔV is a diverse portion of capacitance C1 relative to both capacitance C1 and the effective capacitance Coled, i.e., ΔV=C1/(C1+Coled)×(Vdata−Vref). After this period t3, the voltage on the data line should be reset to zero for easing a detection of a voltage variation on the data line during a next period t4. The storage capacitor C1 is configured to maintain the voltage difference $V_{AB}$ between the first node A and the second node B substantially stable.

In the sampling period t4, all control signals are set as: G1=0, G2=1, G3=0, V1=1, and V2=0. DT1, T2, and T4 are in conduction state. T1, T3, and T5 are in block state. Now, the data line has been reset to zero voltage. The second node B is floating at the second voltage $V_B$=Vref−Vth+ΔV. T2 is in conduction state so that the data line is charged by the second voltage at the second node B. In other words, the data line collects a voltage signal from the second voltage at the second node B. T4 is in conduction state so that the current can be collected from the data line and passed through the fourth transistor T4 to the ADC sub-circuit 8. As we know that the second voltage $V_B$=Vref−Vth+ΔV contains information about current electrical properties of the driving transistor DT1 including threshold voltage and particularly carrier mobility. The voltage signal collected at the data line is received by the ADC sub-circuit 8 as an analog signal. The ADC sub-circuit 8 converts this analog signal to a digital signal and sent to an external processor. Using a certain compensation algorithm, the processor is able to obtain a compensation voltage based on the second voltage at the second node. The obtained compensation voltage can be further used to generate a compensated data signal in accordance with an original data signal Vdata (per pixel circuit). The compensated data voltage, once it is applied back to the data line, can make a proper compensation to substantially eliminate any drift effect of the threshold voltage and carrier mobility of the driving transistor DT1. In the embodiment, the second voltage at the second node B, which is also coupled to the first electrode of the OLED in the driving path from the first power supply Vdd to the second power supply Vss (or ground), is also affected by an IR drop across the OLED. Therefore, the compensated data signal obtained based on the current signal collected from the data line corresponding to the voltage level at the second node B is also able to provide a compensation of potential variation of IR drop of the OLED due to its electrical property drift.

In an example, a formula $I \cdot t = C \cdot \Delta U$ is applicable to the driving transistor DT1. I represents a current flowing through the driving transistor, C represents a parasitic capacitance of the data line which is a constant, AU represents a voltage change on the data line which is changed from zero (reset after t3 period) to Vref−Vth+ΔV, i.e., ΔU=Vref−Vth+ΔV, and t represents a time duration of t4 period for the data line to be fully charged from the second node B. The current I is then changing with the variation of ΔU. Since the current I flowing through the driving transistor DT1 is proportional to the carrier mobility $\mu_n$ thereof, the voltage change ΔU on the data line can be used to deduce a compensation voltage for compensating the drift of the carrier mobility $\mu_n$.

Additionally, in the voltage $V_B$=Vref−Vth+ΔV at the second node B, ΔV and Vref can be obtained by calculation. The voltage $V_B$ itself is sensed by the ADC sub-circuit 8. Therefore, in the above process, the value of threshold voltage Vth associated with the driving transistor currently in real time can also be captured.

In the emission period t5, the control signals are set as: G1=1, G2=0, G3=0, V1=0, V2=1. Thus, the driving transistor DT1, the first switch transistor T1, and the fifth switch transistor T5 are in conduction state. T2, T3, and T4 are turned off. T5 is turned on so that the compensated data signal can be converted to an analog compensated data voltage to be sent back to the data line. From the data line, the compensated data voltage is applied to the first node A to cause the driving transistor DT1 to determine a driving current $I_d$ flowing to the OLED. The driving current $I_d$ drives the OLED to emit light with a desired intensity the substantially eliminates drifts of electrical properties associated with the driving transistor as well as the OLED itself. Therefore, when different pixel circuits in a display panel receive a same original data signal, respect images can be displayed with a same luminance as each pixel circuit can be individually compensated to use corresponding compensated data signals to drive different pixel circuits for emitting light with potential different drifts being independently eliminated. This can substantially enhance image luminance uniformity in entire display area of the display panel.

Figure 4:
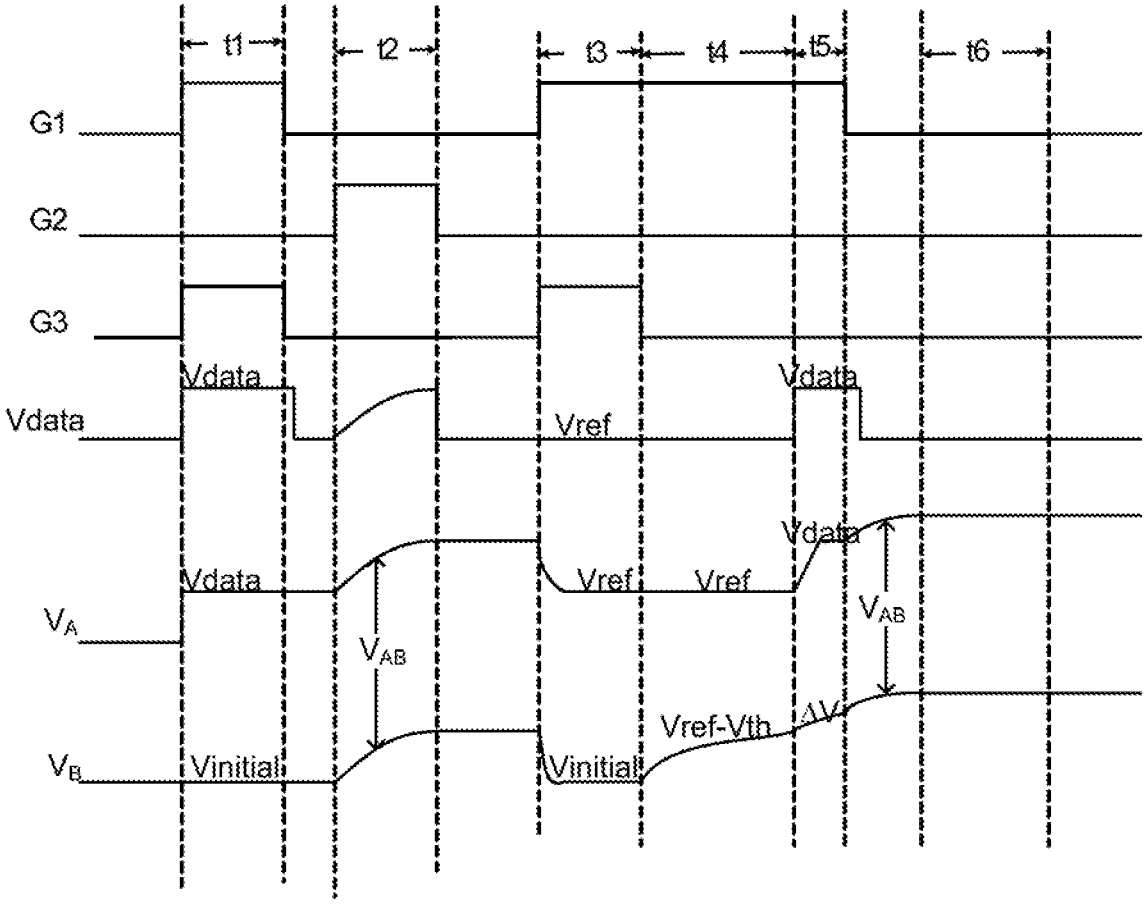
FIG. 4 is a timing diagram of operating the OLED pixel circuit according to another embodiment of the present disclosure.

FIG. 4 shows an alternative example of applying major control signals and setting corresponding voltages at data line and circuit nodes according to a timing waveform for a single cycle of displaying a frame of pixel image. In this example, the cycle includes 6 periods of operating the pixel circuit: a node-reset period t1, a sampling period t2, a reset period t3, a threshold-compensation period t4, a data-input period t5, and an emission period t6. In particular, the operation of the pixel circuit includes the first two periods (t1 and t2) executed for an external compensation followed by four periods (t3-t6) executed for an internal compensation. Optionally, a compensated data signal obtained in the first two periods may be inputted immediately after the first two periods and may be inputted after one or more cycles during which only the internal compensations are performed. The pixel circuit of the present disclosure allows such flexibility of making proper external compensation less frequently to save a lot of time and power of the processor to process a huge amount of data for a plurality of pixel circuits (e.g., 3×1080×1920) in the OLED display panel.

Referring to FIG. 4, in the node-reset period t1, the control signals are set to: G1=1, G2=0, G3=1, V1=0, and V2=0. The driving transistor DT1, the first switch transistor T1, and the third switch transistor T3 are turned on in to a conduction state. The second switch transistor T2, the fourth switch transistor T4, and the fifth switch transistor T5 are turned off to be a block state. In this period, the data line is provided with a data signal which corresponds to a voltage of Vdata. The voltage Vdata is applied via the first switch transistor T1 to the first node A. Thus, $V_A$=Vdata. The reset line is provided with a reset signal Vinitial. Correspondingly, a reset voltage Vinitial is applied through the third switch transistor T3 to the second node B, i.e., $V_B$=Vinitial. This period is called no-reset period as both the first node A and the second node B are reset to respect voltages no matter what their previous voltage level is. In particular, the voltage Vdata is the same as an original data voltage supposed to be applied to the corresponding pixel circuit of the display panel through a progressive scanning-input scheme for displaying a frame of image. Of course, in this period, no current is yet generated to flow into the OLED to drive for light emission. Optionally, after the node-reset period t, the data line should be reset in a gap time to zero voltage and be a floating state.

In the sampling period t2, the control signals are set as: G1=0, G2=1, G3=0, V1=1, and V2=0. DT1 is still in conduction state as the voltage at the first node A remains at Vdata. The first node A is in floating state. T2 and T4 are turned on in this period. T1, T3, and T5 are turned off. In the period t2, the first power supply Vdd can charge the second node B to a first voltage higher than the previous level of Vinitial with a current I flown through the driving transistor DT1 in a duration of t. The first power supply Vdd can further charge the data line in the same duration of t to cause a change of voltage ΔU when T2 is in conduction state. Since the data line has been reset to zero voltage during the gap time after the period t1, the change of voltage ΔU at the data line is just a voltage collected at the data line corresponding to the first voltage at the second node B at the end of the duration t. Assuming the data line bears a fixed parasitic capacitance C, the above charging process leads to a formula: $I \cdot t = C \cdot \Delta U$. When T4 is turned on in this period to allow the voltage collected at the data line to be passed as an analog signal to the ADC sub-circuit 8. The ADC sub-circuit 8 is configured to convert the analog signal to a digital signal sent to an external processor to calculate a compensation voltage based on the first voltage at the second node B using a certain compensation algorithm. Since the current I flown through the driving transistor is directly depended on the carrier mobility thereof and ΔU is changing only when the current I is changing, the compensation voltage calculated by the processor should bear all information for at least properly compensating the drift of carrier mobility. In fact, the current I also bears information about other electrical properties of the driving transistor as well as the OLED, both coupled to the second node. Thus the compensation voltage should also be used for make compensation to drifts of the other electric properties of both the driving transistor and the OLED itself. Optionally, the compensation voltage is used to generate a compensated data signal by the processor for a specific pixel circuit by considering an original data voltage supposed to apply to the pixel circuit before compensation.

Optionally, the compensated data signal is deduced after the sampling period t2 by the external processor. The compensated data signal is able to provide an external compensation to the driving current $I_d$ for driving the OLED to emit light with an intensity being substantially independent from at least the drift of carrier mobility of the driving transistor DT1 as well as the drift of threshold voltage of DT1 and variation of OLED itself.

Optionally, the compensated data signal is sent back to the data line as a compensated data voltage converted from a digital signal by a DAC sub-circuit 10 in an emission period after the sampling period t2. When T5 is turned on in the emission period and the data line is reset to zero voltage, this compensated data voltage is loaded to the data line and can be passed to the first node A to control the driving transistor DT1 to generate a driving current $I_d$ to drive the OLED to emit light for completing the external compensation. Optionally, this emission period may be executed once after one or more cycles of displaying one or more frames of images during which only internal compensation is performed to make the driving current $I_d$ to be independent from a threshold voltage Vth of the driving transistor DT1.

Referring to FIG. 4, in the reset period t3, G1=1, G2=0, G3=1, V1=0, and V2=0. DT1, T1, and T3 are turned on and T2, T4, and T5 are turned off. The first node A is reset to $V_A$=Vref by applying the data line voltage Vdata=Vref. The second node B is reset to $V_B$=Vinitial.

In the threshold-compensation period t4, G1=1, G2=0, G3=0, V1=0, V2=0. DT1 and T1 are turned on and T2, T3, T4, and T5 are turned off. Data line is applied with a same voltage Vref which is passed to the first node A. $V_A$=Vref. The second node B is charged by the first power supply Vdd through the DT1 to Vref−Vth, where Vth is the threshold voltage of the driving transistor DT1.

In the data-input period t5, G1=1, G2=0, G3=0, V1=0, and V2=0. DT1 and T1 are in conduction state and T2, T3, T4, and T5 are in block state. Data line now is supplied with the voltage Vdata, i.e., the original data voltage before compensation for displaying the pixel image. The voltage Vdata is passed to the first node A. $V_A$=Vdata. Due to a coupling effect of the storage capacitor C1, the voltage $V_B$ at the second node is changed to a third voltage of Vref−Vth+ΔV, where ΔV=C1/(C1+Coled)·(Vdata−Vref) is a diverse portion of the voltage Vdata−Vref on the storage capacitor C1 with respect to total capacitance C1 plus an effective capacitance Coled of the OLED. The storage capacitor C1 is configured to maintain the voltage difference $V_{AB}$ between the first node A and the second node B substantially stable.

In the emission period t6, G1=0, G2=0, G3=0, V1=0, and V2=0. DT1 remains in conduction state due to the voltage $V_A$=Vdata at the first node A. T1, T2, T3, T4, and T5 all are turned off. The driving transistor drives the OLED to emit light by generating a driving current $I_d$ flown through DT1 to the first electrode of OLED (with the second electrode being grounded or coupled to the second power supply Vss) based on a gate-source voltage Vgs=$V_{AB}$=Vdata−Vref+Vth−ΔV. The driving current $I_d$ can be expressed as:

$$I_d = \frac{1}{2}\cdot\mu_n\cdot Cox\cdot\frac{W}{L}\cdot[Vdata - Vref + Vth - \Delta V - Vth]^2$$
$$= \frac{1}{2}\cdot\mu_n\cdot Cox\cdot\frac{W}{L}\cdot[Vdata - Vref - \Delta V]^2$$

$\mu_n$ is carrier mobility, Cox is gate oxide capacitance, W/L is width to length ratio of the driving transistor. As seen, the threshold voltage Vth is canceled in the final term of the formula as a result of the internal compensation to eliminate threshold voltage drift effect associated with the pixel circuit. In an alternative embodiment, an alternative emission period may include sending a compensated data signal determined by an external processor back to the data line to replace the original data voltage Vdata (as shown earlier after the sampling period t2), the drift effect of carrier mobility or other electric properties of the driving transistor as well the OLED in the pixel circuit can be compensated. Thereby, whenever different pixels of the OLED display panel receives a same data signal, they are able to produce pixel images with the same desired luminance without being affected by drifts of the threshold voltage or carrier mobility. The uniformity of image luminance in the display area of the OLED display panel is substantially enhanced.

Figure 5:
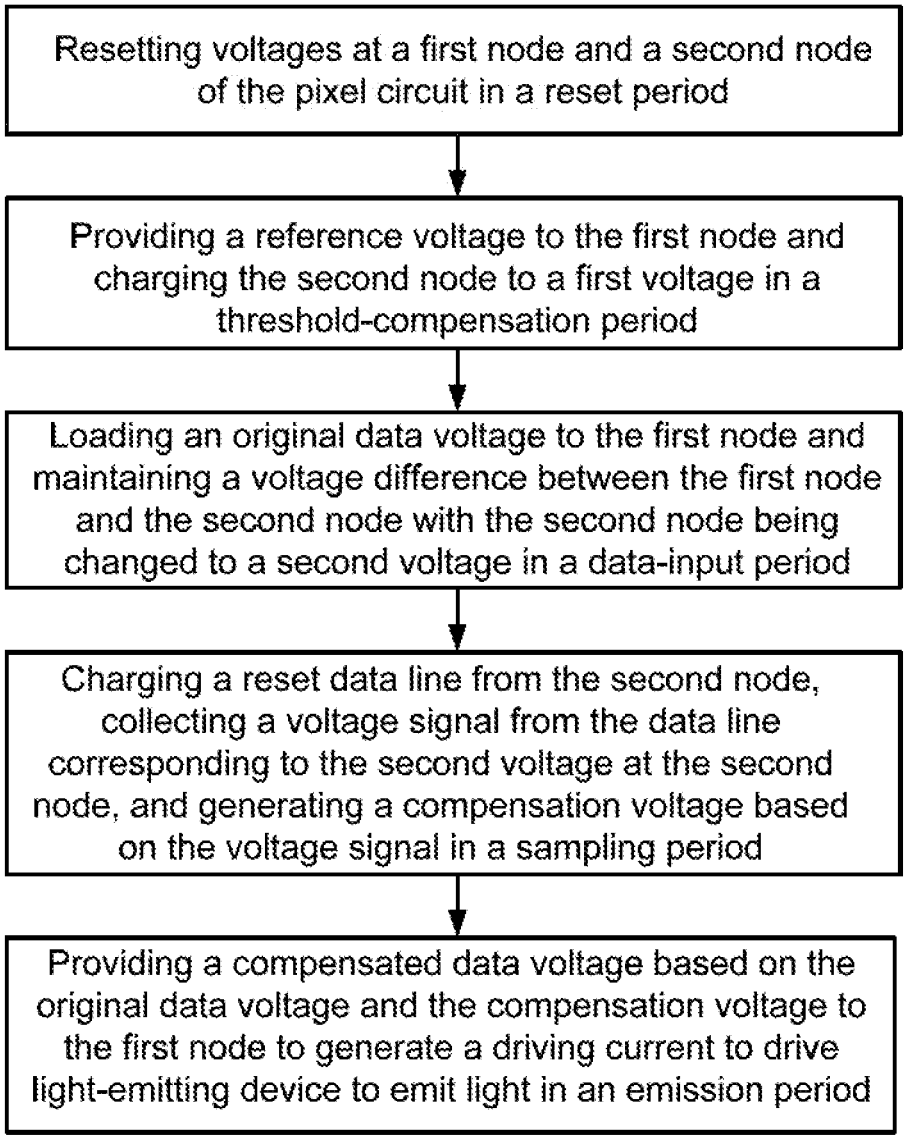
FIG. 5 is a flow chart showing a method of driving the OLED pixel circuit according to an embodiment of the present disclosure.

In another aspect, the present disclosure provides a method of driving the pixel circuit described herein in each cycle of displaying a frame of image. FIG. 5 is a flow chart showing a method of driving the OLED pixel circuit of FIG. 2 according to an embodiment of the present disclosure. Referring to FIG. 5, the method includes, in a reset period of the cycle, supplying the first control signal from the first scan line G1 to control the data-input sub-circuit 1 to connect the data line Data to the first node A; applying a reference voltage Vref from the data line Data to the first node A; supplying the third control signal from the third scan line G3 to control the reset sub-circuit 3 to connect the reset line Initial to the second node B; and applying a reset voltage Vinitial from the reset line to the second node B. The method further includes, in a threshold-compensation period of the cycle, supplying the first control signal from the first scan line G1 to control the data-input sub-circuit 1 *o* connect the data line Data to the first node A; using the reference voltage Vref at the first node A to make the driving-control sub-circuit 2 in conduction state; and using the first power supply Vdd through the driving-control sub-circuit 2 to charge the second node B to a first voltage equal to the reference voltage Vref minus a threshold voltage Vth associated with the driving-control sub-circuit 2. Additionally, the method includes, in a data-input period of the cycle, supplying the first control signal from the first scan line G1 to control the data-input sub-circuit 1 to connect the data line Data to the first node A; applying an original data voltage Vdata from the data line to the first node A; and using the power-storage sub-circuit 4 to maintain a voltage difference $V_{AB}$ between the first node A and the second node B and change the second node B to a second voltage. The method further includes, in a sampling period, supplying the second control signal from the second scan line G2 to control the sampling sub-circuit 6 to connect the data line to the second node; using the first power supply Vdd through the driving-control sub-circuit 2 and the sampling sub-circuit 6 to charge the data line, collecting a voltage signal from the data line corresponding to the second voltage at the second node B to determine a compensation voltage based on the voltage signal. Furthermore, the method includes, in an emission period of the cycle, supplying the first control signal from the first scan line G1 to control the data-input sub-circuit 1 to connect the data line Data to the first node A; providing a compensated data voltage to the first node for controlling the driving-control sub-circuit 2 to determine a driving current $I_d$ flown from the first power supply Vdd through the driving-control sub-circuit 2 to drive the light-emitting device OLED to emit light. The driving current $I_d$ is independent from the threshold voltage Vth and carrier mobility $\mu_n$ drift.

Optionally, the method further includes, in the reset period, supplying the second control signal from the second scan line G2 to control the sampling sub-circuit 6 to disconnect the data line from the second node B; in the threshold-compensation period, supplying the second control signal from the second scan line G2 to control the sampling sub-circuit 6 to disconnect the data line Data from the second node B and supplying the third control signal from the third scan line G3 to control the reset sub-circuit 3 to disconnect the reset line Initial from the second node B.

Optionally, the method further includes, in the data-input period, using the original data voltage Vdata at the first node A to make the driving-control sub-circuit 2 in conduction state, supplying the second control signal from the second scan line G2 to control the sampling sub-circuit 6 to disconnect the data line Data from the second node B and supplying the third control signal from the third scan line G3 to control the reset sub-circuit 3 to disconnect the reset line Initial from the second node B to maintain the second node B at the second voltage.

Optionally, the method further includes, in the sampling period, supplying the first control signal from the first scan line G1 to control the data-input sub-circuit 1 to disconnect the data line from the first node A and supplying the third control signal from the third scan line G3 to control the reset sub-circuit 3 to disconnect the reset line Initial from the second node B.

Optionally, the method further includes, in the emission period, supplying the second control signal from the second scan line G2 to control the sampling sub-circuit 6 to disconnect the data line Data from the second node B and supplying the third control signal from the third scan line to control the reset sub-circuit 3 to disconnect the reset line from the second node B.

Optionally, the method further includes, after the data-input period and before the sampling period, supplying the first control signal G1 to disconnect the data line from the first node A to make the first node floating at the original data voltage to keep the driving-control sub-circuit 2 in conduction state, and resetting the data line Data to a zero voltage before being charged through the sampling sub-circuit 6 in the sampling period.

Optionally, in the sampling period, the method of collecting a voltage signal from the data line corresponding to the second voltage at the second node to determine a compensation voltage includes supplying the first select signal at a turn-on level to turn the first select switch sub-circuit to an on-state, sending the voltage signal to an ADC sub-circuit to convert the voltage signal to a digital signal, sending the digital signal to a processor to calculate a compensation voltage based on the second voltage at the second node and to calculate the compensated data voltage based on the compensation voltage and an original data voltage.

Optionally, in the emission period, the method of providing a compensated data voltage to the first node includes supplying the second select signal at a turn-on level to turn the second select switch sub-circuit to an on-state, sending the compensated data voltage from an DAC sub-circuit to the data line through the data-input sub-circuit to the first node.

Figure 6:
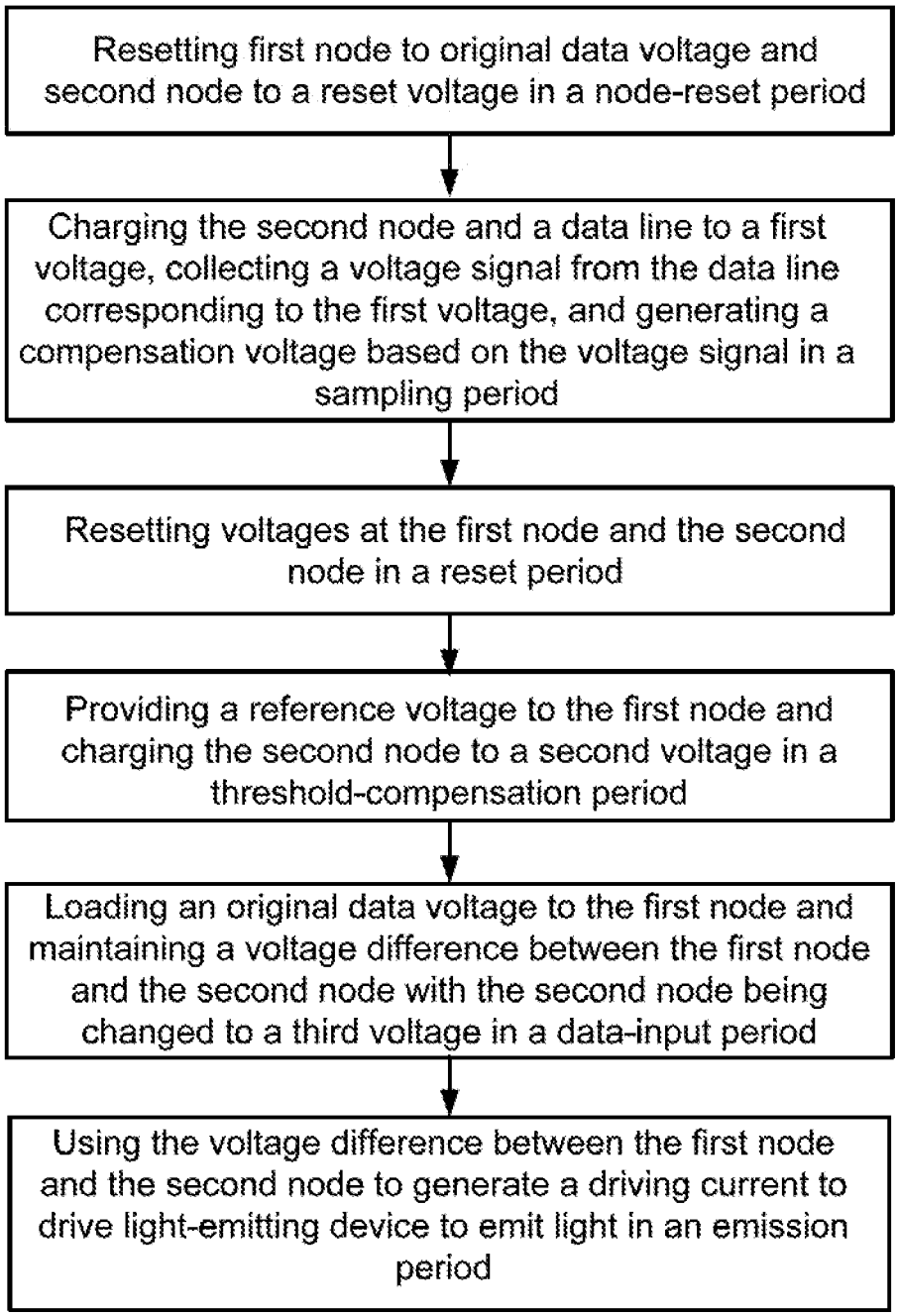
FIG. 6 is a flow chart showing a method of driving the OLED pixel circuit according to another embodiment of the present disclosure.

In an alternative embodiment, FIG. 6 shows a flow chart showing a method of driving the OLED pixel circuit of FIG. 2 according to another embodiment of the present disclosure. Referring to FIG. 6, the method of driving the pixel circuit in each cycle of displaying a frame of image includes, in the node-reset period, supplying the first control signal from the first scan line G1 to control the data-input sub-circuit 1 to connect the data line Data to the first node A, providing an original data voltage Vdata from the data line Data to the first node A, supplying the third control signal from the third scan line G3 to control the reset sub-circuit 3 to connect the reset line Initial to the second node B, providing the reset voltage Vinitial from the reset line to the second node B. After the node-reset period, the method further includes resetting the data line to zero voltage.

The method further includes, in the sampling period, supplying the second control signal from the second scan line G2 to control the sampling sub-circuit 6 to connect the data line Data to the second node B, charging the data line Data from the first power supply Vdd through the driving-control sub-circuit 2 and the sampling sub-circuit 6 while charging the second node B to a first voltage, collecting a voltage signal from the data line Data corresponding to the first voltage at the second node B and to determine a compensation voltage based on the first voltage. The compensation voltage is calculated based on current electric properties associated with the driving-control sub-circuit 2 and the light-emitting device OLED and is used to determine a compensated data signal.

Furthermore, the method includes, in the reset period, supplying the first control signal from the first scan line G1 to control the data-input sub-circuit 1 to connect the data line Data to the first node A; applying a reference voltage Vref from the data line Data to the first node A; supplying the third control signal from the third scan line G3 to control the reset sub-circuit 3 to connect the reset line Initial to the second node B; and applying a reset voltage Vinitial from the reset line to the second node B.

The method further includes, in the threshold-compensation period, supplying the first control signal from the first scan line G1 to control the data-input sub-circuit 1 to connect the data line Data to the first node A; using the reference voltage Vref at the first node A to make the driving-control sub-circuit in conduction state; and using the first power supply Vdd through the driving-control sub-circuit 2 to charge the second node B to a second voltage equal to the reference voltage Vref minus a threshold voltage Vth associated with the driving-control sub-circuit 2.

The method further includes, in the data-input period, supplying the first control signal from the first scan line G1 to control the data-input sub-circuit 1 to connect the data line Data to the first node A; applying an original data voltage Vdata from the data line Data to the first node A; and using the power-storage sub-circuit 4 to maintain a voltage difference $V_{AB}$ stable between the first node A and the second node B with the second node B being changed to a third voltage.

Moreover, the method includes, in the emission period, supplying all the first control signal, the second control signal, and the third control signal at turn-off level to disconnect the data line Data from the first node A and second node B and disconnect the reset line Initial from the second node B, using the voltage difference $V_{AB}$ between the first node A and the second node B maintained by the power-storage sub-circuit 4 to control the driving-control sub-circuit 2 to generate a driving current $I_d$ to drive the light-emitting device OLED to emit light. The driving current $I_d$ is at least independent from the threshold voltage Vth.

In yet another aspect, the present disclosure provides an organic light-emission display panel including a plurality of pixel circuits arranged in a matrix. Each pixel circuit is a pixel circuit described herein and shown in FIG. 2.

In yet still another aspect, the present disclosure provides a display apparatus including an organic light-emission display panel described above.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel circuit comprising:

a data-input sub-circuit having a first terminal coupled to a data line, a second terminal coupled to a first scan line configured to be provided with a first control signal, a third terminal coupled to a first node, and being configured to using the first control signal to control application of a data voltage from the data line to the first node;

a reset sub-circuit having a first terminal coupled to a reset line, a second terminal coupled to a third scan line configured to be provided with a third control signal, and a third terminal coupled to a second node, and being configured to using the third control signal to control application of a reset voltage from the reset line to the second node;

a driving-control sub-circuit having a first terminal coupled to a first power supply, a second terminal coupled to the first node, and a third terminal coupled to the second node;

a power-storage sub-circuit having a first terminal coupled to the first node and a second terminal coupled to the second node, and being configured to regulate a voltage difference between the first node and the second node;

a light-emitting device having a first terminal coupled to the second node and a second terminal coupled to a second power supply; and a sampling sub-circuit having a first terminal coupled to the data line, a second terminal coupled to a second scan line configured to be provided with a second control signal, and a third terminal coupled to the second node, and being configured to use the second control signal to control the second node being connected to the data line;

wherein an ADC sub-circuit is coupled to the data line through a first switch sub-circuit and is configured to collect an analog voltage signal in the data line during a sampling period of the pixel circuit when the first switch sub-circuit is in conduction state and convert the analog voltage signal to a digital signal which is used by a processor to calculate a compensated data voltage;

wherein a DAC sub-circuit is configured to convert a digital signal associated with the compensated data voltage to an analog voltage signal and is coupled to the data line through a second switch sub-circuit to send the analog voltage signal to the data line during an emission period of the pixel circuit when the second switch sub-circuit is in conduction state.

2. The pixel circuit of claim 1, wherein the driving-control sub-circuit comprises a driving transistor having a gate being the second terminal of the driving-control sub-circuit coupled to the first node, a source being the first terminal of the driving-control sub-circuit coupled to the first power supply, and a drain being the third terminal of the driving-control sub-circuit coupled to the second node.

3. The pixel circuit of claim 1, wherein the data-input sub-circuit comprises a first switch transistor having a gate being the second terminal of the data-input sub-circuit coupled to the first scan line, a source being the first terminal of the data-input sub-circuit coupled to the data line, and a drain being the third terminal of the data-input sub-circuit coupled to the first node.

4. The pixel circuit of claim 1, wherein the sampling sub-circuit comprises a second switch transistor having a gate being the second terminal of the sampling sub-circuit coupled to the second scan line, a source being the third terminal of the sampling sub-circuit coupled to the second node, and a drain being the first terminal of the sampling sub-circuit coupled to the data line.

5. The pixel circuit of claim 1, wherein the reset sub-circuit comprises a third switch transistor having a gate being the second terminal of the reset sub-circuit coupled to the third scan line, a source being the first terminal of the reset sub-circuit coupled to the reset line, and a drain being the third terminal of the reset sub-circuit coupled to the second node.

6. The pixel circuit of claim 1, wherein the power-storage sub-circuit comprises a capacitor having a first terminal being the first terminal of the power-storage sub-circuit coupled to the first node and a second terminal being the second terminal of the power-storage sub-circuit coupled to the second node.

7. The pixel circuit of claim 1, wherein the first power supply provides a positive voltage and the second power supply provides a negative voltage or is grounded.

8. The pixel circuit of claim 1, further comprising wherein the first switch sub-circuit comprises a fourth switch transistor having a gate being controlled by a first select signal, a source coupled to the data line, and a drain coupled to the ADC sub-circuit;

wherein the first select signal is configured to be set to a turn-on level to make the first switch sub-circuit in conduction state;

wherein the second switch sub-circuit comprises a fifth switch transistor having a gate being controlled by a second select signal, a source coupled to the DAC sub-circuit, and a drain coupled to the data line; and wherein the second select signal is configured to be set to a turn-on level to make the second switch-sub-circuit in conduction state.

9. A method of driving a pixel circuit of claim 1 in each cycle of displaying a frame of image, wherein the cycle includes a reset period, a threshold-compensation period, a data-input period, a sampling period, and an emission period, the method comprising:

in the reset period, supplying the first control signal from the first scan line to control the data-input sub-circuit to connect the data line to the first node; applying a reference voltage from the data line to the first node; supplying the third control signal from the third scan line to control the reset sub-circuit to connect the reset line to the second node; and applying the reset voltage from the reset line to the second node;

in the threshold-compensation period, supplying the first control signal from the first scan line to control the data-input sub-circuit to connect the data line to the first node; using the reference voltage at the first node to make the driving-control sub-circuit in conduction state; and using the first power supply through the driving-control sub-circuit to charge the second node to a first voltage equal to the reference voltage minus a threshold voltage associated with the driving-control sub-circuit;

in the data-input period, supplying the first control signal from the first scan line to control the data-input sub-circuit to connect the data line to the first node; applying an original data voltage from the data line to the first node; and using the power-storage sub-circuit to maintain a voltage difference stable between the first node and the second node and change the second node to a second voltage;

in the sampling period, supplying the second control signal from the second scan line to control the sampling sub-circuit to connect the data line to the second node; using the first power supply through the driving-control sub-circuit and the sampling sub-circuit to charge the data line, collecting a voltage signal from the data line corresponding to the second voltage at the second node to determine a compensation voltage based on the voltage signal; and in the emission period, supplying the first control signal from the first scan line to control the data-input sub-circuit to connect the data line to the first node; providing a compensated data voltage to the first node for controlling the driving-control sub-circuit to determine a driving current flown from the first power supply through the driving-control sub-circuit to drive the light-emitting device to emit light, wherein the driving current is independent from the threshold voltage and carrier mobility drift.

10. The method of claim 9, further comprising:

in the reset period, supplying the second control signal from the second scan line to control the sampling sub-circuit to disconnect the data line from the second node;

in the threshold-compensation period, supplying the second control signal from the second scan line to control the sampling sub-circuit to disconnect the data line from the second node and supplying the third control signal from the third scan line to control the reset sub-circuit to disconnect the reset line from the second node;

in the data-input period, using the original data voltage at the first node to make the driving-control sub-circuit in conduction state, supplying the second control signal from the second scan line to control the sampling sub-circuit to disconnect the data line from the second node and supplying the third control signal from the third scan line to control the reset sub-circuit to disconnect the reset line from the second node to maintain the second node at the second voltage;

in the sampling period, supplying the first control signal from the first scan line to control the data-input sub-circuit to disconnect the data line from the first node and supplying the third control signal from the third scan line to control the reset sub-circuit to disconnect the reset line from the second node; and in the emission period, supplying the second control signal from the second scan line to control the sampling sub-circuit to disconnect the data line from the second node and supplying the third control signal from the third scan line to control the reset sub-circuit to disconnect the reset line from the second node.

11. The method of claim 9, further comprising, after the data-input period and before the sampling period, supplying the first control signal from the first scan line to disconnect the data line from the first node to make the first node floating at the original data voltage to keep the driving-control sub-circuit in conduction state, and resetting the data line to a zero voltage before being charged through the sampling sub-circuit in the sampling period.

12. The method of claim 11, wherein, in the sampling period, the collecting a voltage signal from the data line corresponding to the second voltage at the second node to determine a compensation voltage comprises supplying the first select signal at a turn-on level to turn the first select switch sub-circuit to an on-state, sending the voltage signal to an ADC sub-circuit to convert the voltage signal to a digital signal, sending the digital signal to a processor to calculate a compensation voltage based on the second voltage at the second node and to calculate the compensated data voltage based on the compensation voltage and an original data voltage.

13. The method of claim 9, wherein in the emission period, the providing a compensated data voltage to the first node comprises supplying the second select signal at a turn-on level to turn the second select switch sub-circuit to an on-state, sending the compensated data voltage from an DAC sub-circuit to the data line through the data-input sub-circuit to the first node.

14. A method of driving a pixel circuit of claim 1 in each cycle of displaying a frame of image, wherein the cycle includes a node-reset period, a sampling period, a reset period, a threshold-compensation period, a data-input period, and an emission period, the method comprising:

in the node-reset period, supplying the first control signal from the first scan line to control the data-input sub-circuit to connect the data line to the first node, providing an original data voltage from the data line to the first node, supplying the third control signal from the third scan line to control the reset sub-circuit to connect the reset line to the second node, providing the reset voltage from the reset line to the second node;

in the sampling period, supplying the second control signal from the second scan line to control the sampling sub-circuit to connect the data line to the second node, charging the data line from the first power supply through the driving-control sub-circuit and the sampling sub-circuit while charging the second node to a first voltage, collecting a voltage signal from the data line corresponding to the first voltage at the second node and to determine a compensation voltage based on the first voltage, wherein the compensation voltage is calculated based on current electric properties associated with the driving-control sub-circuit and the light-emitting device and is used to determine a compensated data signal;

in the reset period, supplying the first control signal from the first scan line to control the data-input sub-circuit to connect the data line to the first node; applying a reference voltage from the data line to the first node; supplying the third control signal from the third scan line to control the reset sub-circuit to connect the rest line to the second node; and applying a reset voltage from the reset line to the second node;

in the threshold-compensation period, supplying the first control signal from the first scan line to control the data-input sub-circuit to connect the data line to the first node; using the reference voltage at the first node to make the driving-control sub-circuit in conduction state;

and using the first power supply through the driving-control sub-circuit to charge the second node to a second voltage equal to the reference voltage minus a threshold voltage associated with the driving-control sub-circuit;

in the data-input period, supplying the first control signal from the first scan line to control the data-input sub-circuit to connect the data line to the first node; applying an original data voltage from the data line to the first node; and using the power-storage sub-circuit to maintain a voltage difference stable between the first node and the second node with the second node being changed to a third voltage; and in the emission period, supplying all the first control signal, the second control signal, and the third control signal at turn-off level to disconnect the data line from the first node and second node and disconnect the reset line from the second node, using the voltage difference between the first node and the second node maintained by the power-storage sub-circuit to control the driving-control sub-circuit to generate a driving current to drive the light-emitting device to emit light, wherein the driving current is at least independent from the threshold voltage.

15. The method of claim 14, further comprising, after the node-reset period and before the sampling period, supplying the first control signal from the first scan line to disconnect the data line from the first node to make the first node floating at the original data voltage to keep the driving-control sub-circuit in conduction state, and resetting the data line to a zero voltage before being charged through the sampling sub-circuit in the sampling period.

16. The method of claim 14, wherein, in the sampling period, the charging the data line comprises supplying the first control signal from the first scan line to control the data-input sub-circuit to disconnect the data line from the first node to make the first node floating, and supplying the third control signal from the third scan line to control the reset sub-circuit to disconnect the reset line from the second node.

17. The method of claim 14, wherein, in the sampling period, the collecting a voltage signal from the data line corresponding to the first voltage at the second node to determine a compensation voltage comprises supplying the first select signal at a turn-on level to turn the first select switch sub-circuit to an on-state, sending the voltage signal to an ADC sub-circuit to convert the voltage signal to a digital signal, sending the digital signal to a processor to calculate a compensation voltage based on the first voltage at the second node and to calculate the compensated data voltage based on the compensation voltage and an original data voltage.

18. The method of claim 14, further comprising, in an alternate emission period after the sampling period, supplying the first control signal from the first scan line to control the data-input sub-circuit to connect the data line to the first node, supplying the second select signal at a turn-on level to turn the second select switch sub-circuit to an on-state, sending the compensated data voltage from an DAC sub-circuit to the data line through the data-input sub-circuit to the first node, using the compensated data voltage to control the driving-control sub-circuit to determine a driving current to drive the light-emitting device to emit light, wherein the driving current is independent from electrical property drifts associated with the driving-control sub-circuit and the light-emitting device.

19. An organic light-emission display panel comprising a plurality of pixel circuits of claim 1.

20. A display apparatus comprising an organic light-emission display panel of claim 19.

* * * * *